US011274677B2

(12) United States Patent
Chinoda et al.

(10) Patent No.: US 11,274,677 B2
(45) Date of Patent: Mar. 15, 2022

(54) BLOWER ASSEMBLY

(71) Applicant: Revcor, Inc., Carpentersville, IL (US)

(72) Inventors: Zvirimumwoyo P. Chinoda, Algonquin, IL (US); Nathan K. Shoemaker, Elgin, IL (US); Madan Baral, Huntley, IL (US); Stephen Baker, Wood Dale, IL (US); Stephen A. Adamski, Prospect Heights, IL (US)

(73) Assignee: Revcor, Inc., Carpentersville, IL (US)

( * ) Notice: Subject to any disclaimer, the term of this patent is extended or adjusted under 35 U.S.C. 154(b) by 42 days.

(21) Appl. No.: 16/661,542

(22) Filed: Oct. 23, 2019

(65) Prior Publication Data

US 2020/0132085 A1 Apr. 30, 2020

Related U.S. Application Data

(60) Provisional application No. 62/857,061, filed on Jun. 4, 2019, provisional application No. 62/750,814, filed on Oct. 25, 2018.

(51) Int. Cl.
*F04D 29/42* (2006.01)
*F04D 29/28* (2006.01)

(52) U.S. Cl.
CPC ..... *F04D 29/4206* (2013.01); *F04D 29/281* (2013.01)

(58) Field of Classification Search
CPC ..... F04D 29/4206; F04D 29/281
See application file for complete search history.

(56) References Cited

U.S. PATENT DOCUMENTS

| | | | |
|---|---|---|---|
| 641,328 | A | 1/1900 | Royal |
| 683,832 | A | 10/1901 | Baker |
| 1,614,269 | A | 1/1927 | Woodruff |
| 1,673,073 | A | 6/1928 | Houghtby |
| 1,959,736 | A | 5/1934 | Rademacher |
| 1,967,821 | A | 7/1934 | Hess |

(Continued)

FOREIGN PATENT DOCUMENTS

| | | |
|---|---|---|
| EP | 0785362 | 7/1997 |
| GB | 2126653 | 3/1984 |

(Continued)

OTHER PUBLICATIONS

Cho, Yong, et al., "Discrete Noise Prediction of Variable Pitch Cross-Flow Fans by Unsteady Navier-Stokes Computations." Journal of Fluids Engineering, vol. 125, May 2003, pp. 543-550.

(Continued)

*Primary Examiner* — Shafiq Mian
(74) *Attorney, Agent, or Firm* — Fitch, Even, Tabin & Flannery LLP

(57) ABSTRACT

In accordance with one aspect of the current disclosure, a blower assembly is provided that includes a housing having a pair of side walls and an outer wall connecting the side walls. The outer wall has a cutoff portion and an outlet portion. The housing includes an outlet defined at least in part by an outlet end of the outlet portion and the cutoff portion. The outer wall includes a scroll portion connecting the cutoff portion and the outlet portion. The outlet portion flares outwardly away from the cutoff portion as the outlet portion extends from the scroll portion to the outlet end of the outlet portion.

20 Claims, 4 Drawing Sheets

(56) References Cited

U.S. PATENT DOCUMENTS

| | | | | |
|---|---|---|---|---|
| 2,419,411 | A | 4/1947 | Mayne | |
| 2,496,179 | A | 1/1950 | Schwarz | |
| 2,628,419 | A | 2/1953 | Wilken | |
| 2,649,242 | A * | 8/1953 | Payne | F24H 3/065 415/52.1 |
| 2,684,521 | A | 7/1954 | Morrison, Jr. | |
| 2,894,681 | A | 7/1959 | Lunde | |
| 2,910,224 | A | 10/1959 | Campbell | |
| 2,915,240 | A | 12/1959 | Kochevar | |
| 2,932,445 | A | 4/1960 | Hathaway | |
| 2,980,990 | A | 4/1961 | Sprouse | |
| 3,156,408 | A | 11/1964 | Whitenack, Jr. | |
| 3,223,313 | A | 12/1965 | Kinsworthy | |
| 3,228,591 | A | 1/1966 | Goettl | |
| 3,263,910 | A | 8/1966 | Eck | |
| 3,385,511 | A | 5/1968 | Wentling | |
| 3,402,451 | A | 9/1968 | Beesley | |
| 3,450,337 | A | 6/1969 | Jolette | |
| 3,481,530 | A | 12/1969 | Grigorievich | |
| 3,653,116 | A * | 4/1972 | Lov | B21D 51/16 29/243.517 |
| 3,711,914 | A | 1/1973 | Baker | |
| 3,737,966 | A | 6/1973 | Ranz | |
| 3,794,439 | A | 2/1974 | Haase | |
| 3,797,088 | A | 3/1974 | Stettler | |
| 3,809,503 | A | 5/1974 | Schlicker | |
| 3,844,682 | A | 10/1974 | Morris | |
| 3,854,844 | A | 12/1974 | Ranz | |
| 3,921,272 | A | 11/1975 | Klonoski | |
| 3,970,411 | A | 7/1976 | Wallman | |
| 4,041,593 | A | 8/1977 | Wallman | |
| 4,059,215 | A | 11/1977 | Owen | |
| 4,086,028 | A | 4/1978 | Felter | |
| 4,289,450 | A | 9/1981 | Kling | |
| 4,315,357 | A | 2/1982 | Calvano | |
| 4,320,565 | A | 3/1982 | Warchol | |
| 4,329,118 | A | 5/1982 | Ranz | |
| 4,458,400 | A | 7/1984 | Friedericy | |
| 4,470,753 | A | 9/1984 | Witzel | |
| 4,474,534 | A | 10/1984 | Thode | |
| 4,515,527 | A | 5/1985 | Baker | |
| 4,538,963 | A | 9/1985 | Sugio | |
| 4,603,773 | A | 8/1986 | Ducate, Sr. | |
| 4,639,193 | A | 1/1987 | Reichert | |
| 4,653,635 | A | 3/1987 | Ducate, Sr. | |
| 4,701,157 | A | 10/1987 | Potter | |
| 4,723,431 | A | 2/1988 | Mckindary | |
| 4,761,576 | A | 8/1988 | Savage | |
| 4,784,256 | A | 11/1988 | Ducate, Sr. | |
| 4,787,818 | A | 11/1988 | Bales | |
| 5,013,215 | A | 5/1991 | Diehl | |
| 5,060,720 | A | 10/1991 | Wollaber | |
| 5,075,964 | A | 12/1991 | Galliet | |
| 5,266,007 | A | 11/1993 | Bushnell | |
| 5,269,655 | A | 12/1993 | Chang | |
| 5,341,665 | A | 8/1994 | Christophel | |
| 5,388,956 | A | 2/1995 | Pla | |
| 5,478,205 | A | 12/1995 | Chou | |
| 5,551,836 | A | 9/1996 | Roth | |
| 5,570,996 | A | 11/1996 | Smiley, III | |
| 5,685,695 | A | 11/1997 | Klement | |
| 5,873,164 | A | 2/1999 | Klement | |
| 5,934,876 | A | 8/1999 | Nagy | |
| 5,979,205 | A | 11/1999 | Uchida | |
| 6,149,381 | A | 11/2000 | Lee | |
| 6,158,954 | A | 12/2000 | Nabeshima | |
| 6,179,566 | B1 | 1/2001 | Andulics | |
| 6,206,640 | B1 | 3/2001 | Andulics | |
| 6,220,818 | B1 | 4/2001 | Andulics | |
| 6,283,726 | B1 | 9/2001 | Fackelmann | |
| 6,345,951 | B1 | 2/2002 | Choi | |
| 6,345,956 | B1 | 2/2002 | Lin | |
| 6,353,303 | B1 | 3/2002 | Ramachandran | |
| 6,416,285 | B1 | 7/2002 | Fichter | |
| 6,513,219 | B1 | 2/2003 | Lanzarini | |
| 6,609,893 | B2 | 8/2003 | Dobrzeniecki | |
| 6,624,397 | B2 | 9/2003 | Tateishi | |
| 6,761,040 | B2 | 7/2004 | Cheol | |
| 6,776,582 | B2 | 8/2004 | Segawa | |
| 7,017,599 | B2 | 3/2006 | Keefer | |
| 7,052,237 | B2 | 5/2006 | Segawa | |
| 7,210,907 | B2 | 5/2007 | Patti | |
| 7,566,262 | B2 | 7/2009 | Hu | |
| 7,568,493 | B2 | 8/2009 | Keefer | |
| 7,722,311 | B2 | 5/2010 | Peterson | |
| 8,001,958 | B2 | 8/2011 | Post | |
| 8,025,049 | B2 | 9/2011 | Post | |
| 8,881,396 | B2 | 11/2014 | Hall | |
| 9,995,316 | B2 | 6/2018 | Hall | |
| 10,125,784 | B2 | 11/2018 | Hall | |
| 2003/0077174 | A1 | 4/2003 | Kim | |
| 2003/0159803 | A1 | 8/2003 | Hansen | |
| 2005/0042078 | A1 * | 2/2005 | Sturgell | F04D 29/4226 415/128 |
| 2005/0092053 | A1 | 5/2005 | Zhou | |
| 2006/0233638 | A1 | 10/2006 | Chen | |
| 2009/0035132 | A1 * | 2/2009 | Harman | F04D 17/06 415/203 |
| 2009/0129933 | A1 | 5/2009 | Kilian | |
| 2010/0076606 | A1 | 3/2010 | Gatley | |
| 2010/0266397 | A1 * | 10/2010 | Allen | F04D 25/084 415/208.1 |
| 2011/0033325 | A1 | 2/2011 | Ko | |
| 2012/0321494 | A1 | 12/2012 | Duke | |
| 2019/0072109 | A1 * | 3/2019 | Pirouzpanah | F04D 29/464 |
| 2019/0078581 | A1 | 3/2019 | Hall | |
| 2019/0186499 | A1 * | 6/2019 | Pirouzpanah | F04D 29/62 |

FOREIGN PATENT DOCUMENTS

| | | |
|---|---|---|
| JP | 2001271791 | 10/2001 |
| KR | 20070028877 | 3/2007 |

OTHER PUBLICATIONS

Ebm-Mulfingen GmbH & Co. KG, ebmpapst: Centrifugal fans and blowers, version 07, http://www.ebmpapst.com/media/content/info-center/downloads_10/catalogs/centrifu gal_fans_1/Centrifugal_fans_200; accessed Jun. 25, 2010, 616 pages.

Engineering drawing of fan assembly having plastic blades, the fan assembly being publicly available for purchase in 1999, 1 page.

Engineering drawing of the blower housing, Revcor, Inc., publicly available prior to Oct. 25, 2018, 1 page.

Ilberg, H., et al., "Flow Theory and Performance of Tangential Fans," Thermodynamics and Fluid Mechanics Group. Proceedings Institution of Mechanical Engineers, vol. 180, pt. 1, No. 19, published 1965-66, pp. 481-496.

Induction Motor Control Theory, L M Photonics Ltd, <http://www.lmphotonics.com/m_control.htm>, accessed on Feb. 26, 2014, 6 pages.

Lee, Da-Sheng, et al., "Noise Reduction of a Cross-Flow Fan." Journal of the Chinese Institute of Engineers, vol. 20, No. 3, 1997, pp. 265-273.

Mellin, R.C., et al., "Controlling the Tonal Characteristics of the Aerodynamic Noise Generated by Fan Rotors." Journal of Basic Engineering, Mar. 1970, pp. 143-154.

Pictures of Revcor Model BL6507 Fan Assembly, Publicly available before Mar. 11, 2013, 8 pages.

Specification Sheet, Specification of Electric Motors, <http://www.weg.net/>, publicly available at least one year prior to Mar. 11, 2014, p. 55.

The Engineering Toolbox, Types of Fans: Axial and propeller fans, centrifugal (radial) fans, mixed flow fans and cross flow fans, http://www.engineeringtoolbox.com/fan-types-d_142.html, accessed Oct. 7, 2010, 3 pages.

* cited by examiner

BLOWER ASSEMBLY

CROSS-REFERENCE TO RELATED APPLICATIONS

This application claims the benefit of U.S. Provisional Application No. 62/857,061, filed Jun. 4, 2019, and U.S. Provisional Application No. 62/750,814, filed Oct. 25, 2018, which are hereby incorporated herein by reference in their entireties.

FIELD

This disclosure relates to blowers and, more specifically, to blowers for air handler units.

BACKGROUND

Air handler units include forced air furnaces such as furnaces used in homes. Forced air furnaces utilize a blower that blows air across one or more heat exchangers of the furnace to heat the air. The heated air is then directed out of an outlet of the furnace and into ductwork of the associated building.

Some conventional blowers have a housing, a single or double inlet wheel fan within the housing, and a motor for driving the fan. The fan has forward inclined blades that draw air into a center of the fan in a direction parallel to an axis of rotation of the fan as the fan rotates. The fan blades direct the air radially outward against a scroll-shaped outer wall of the housing. The scroll-shaped outer wall extends from a cutoff of the blower housing to a redirecting wall extending perpendicular to a radius of the scroll-shaped outer wall. The fan pushes the air along the scroll-shaped wall until the air reaches the redirecting wall. The redirecting wall redirects airflow from a generally circumferential direction along the scroll-shaped wall to a tangential direction. This redirection is used in conventional blower to direct the air flow outward from an outlet of the blower in a direction normal to a heat exchanger of the furnace.

DETAILED DESCRIPTION

Figure 1:
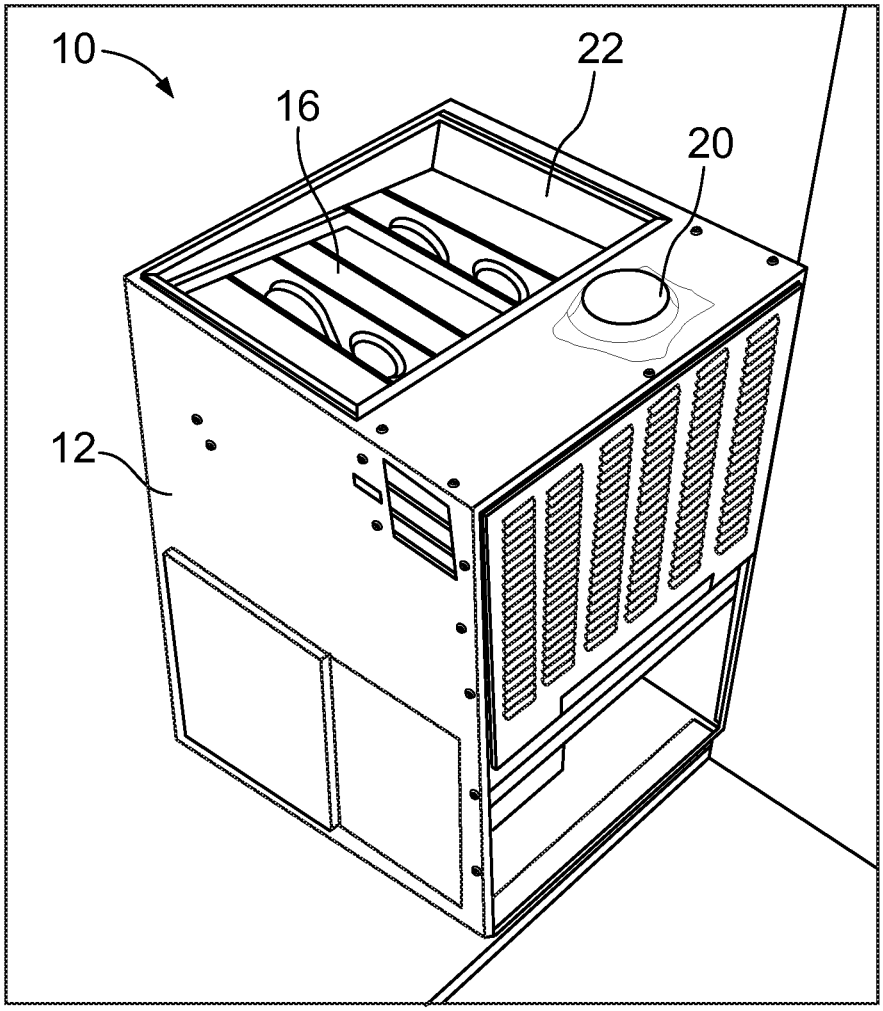
FIG. 1 is a perspective view of a furnace showing an outlet opening of the furnace and a heat exchanger within the furnace.
Figure 2:
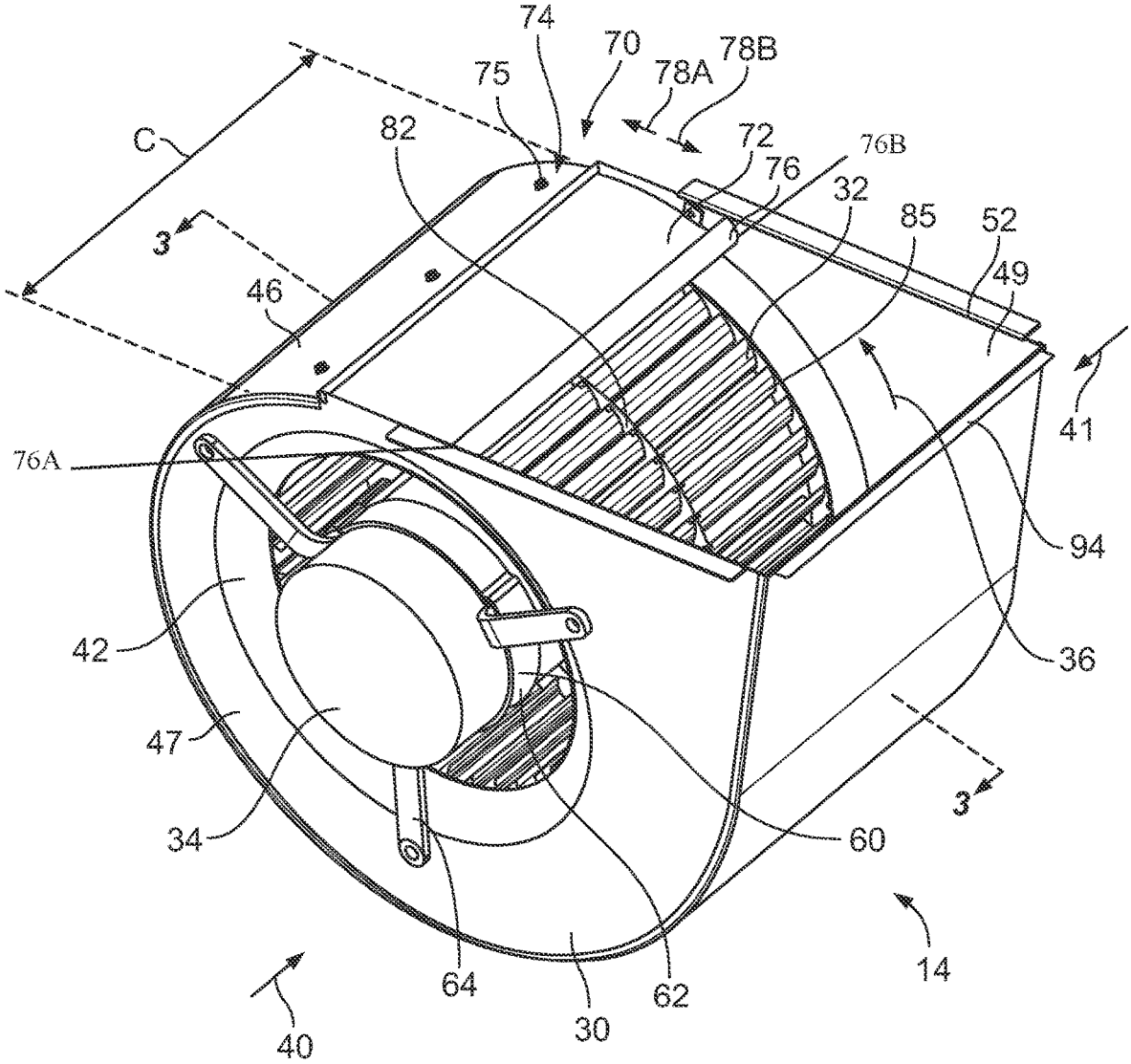
FIG. 2 is a perspective view of a blower of the furnace of FIG. 1 showing a housing of the blower and a cutoff that may be adjusted to change the size of an outlet opening of the blower.
Figure 3:
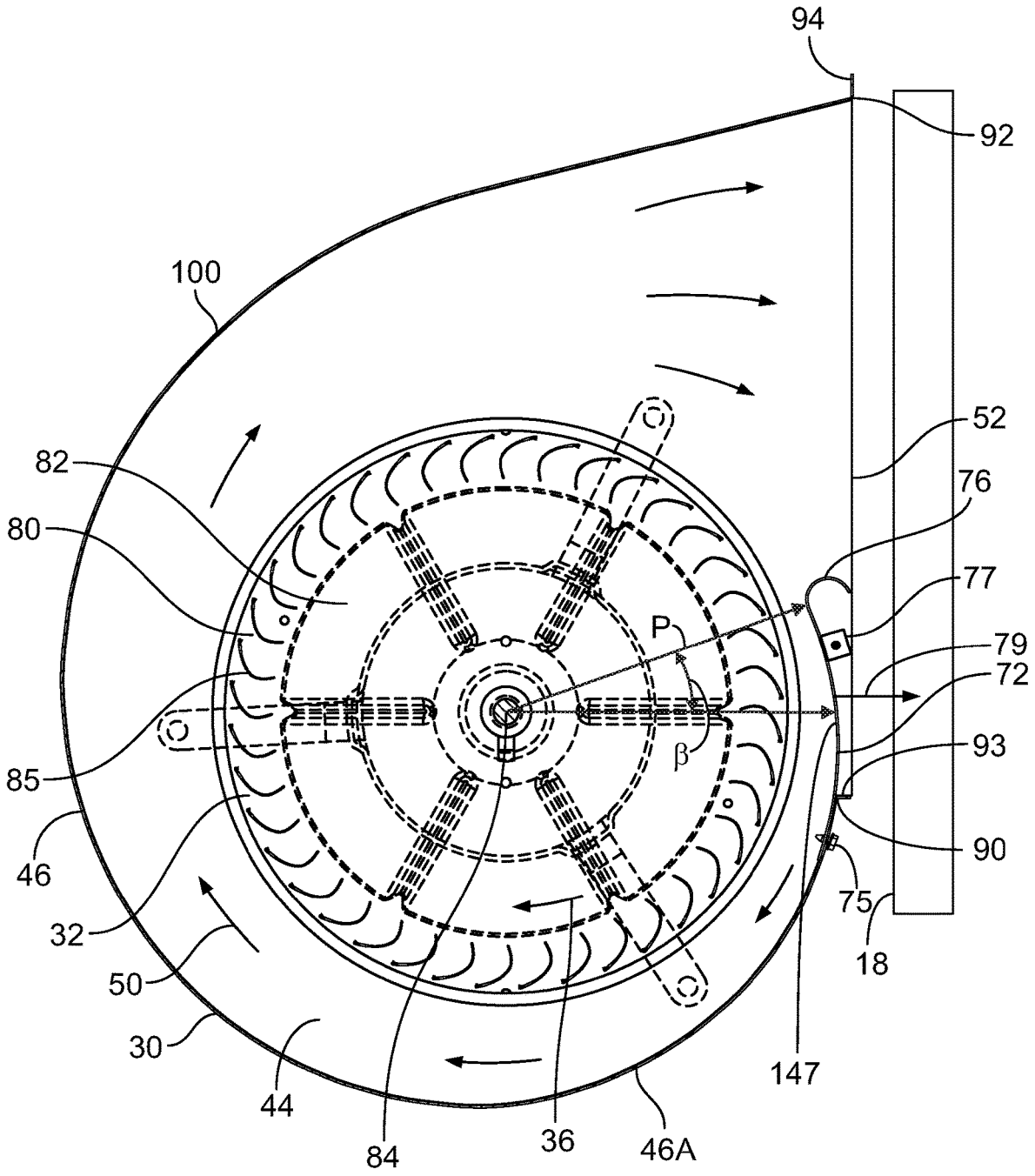
FIG. 3 is a cross-sectional view taken across line 3-3 in FIG. 2 showing the blower directing air at a heat exchanger of the furnace of FIG. 1.

With reference to FIG. 1, a furnace 10 is provided having a furnace housing 12 that contains the components of the furnace 10 such as a blower 14 (see FIG. 2), a heater, and one or more heat exchangers 16, 18 (see FIGS. 1 and 3). The furnace 10 has a flue gas vent 20 and an outlet opening 22. The outlet opening 22 opens to a supply plenum in communication with ductwork of a building.

With reference to FIG. 2, the blower 14 includes a blower housing 30, a wheel fan 32, and a motor 34 for rotating the fan 32 about an axis 104 (see FIG. 4) in direction 36. As the motor 34 turns the fan 32 in direction 36, air is drawn axially in directions 40, 41 through inlet openings 42 of the blower housing 30 and pushed into a volute volume 44 (see FIG. 3) defined between the fan 32 and an outer wall 46 of the blower housing 30. The air is directed in direction 50 generally circumferentially around the fan 32 and outward through an outlet opening 52 of the blower housing 30.

Regarding FIG. 2, the blower housing 30 includes a pair of side walls 47, 49 and the outer wall 46 extends between and connects the side walls 47, 49. The side walls 47, 49 each include one of the inlet openings 42. In another embodiment, the fan 32 is a single inlet fan and only one of the walls 47, 49 has an inlet opening 42. The blower 14 includes a mount 60 with a collar 62 that extends around the motor 34 and arms 64 extending radially outward from the collar 62 that are joined to the side wall 47. The mount 60 supports the motor 34 in the inlet opening 42 of the side wall 47. In one embodiment, the motor is mounted so that the back end of the motor is flush with the sidewall 47. In other embodiments, the back end of the motor 34 may extend beyond the sidewall 47 or be fully contained within the blower housing 30.

The blower 14 includes an adjustable cutoff 70 having a cutoff 72 and a slide connection 74 that permits the cutoff 72 to be adjusted in directions 78A, 78B. The blower 14 may have a cutoff angle β in the range of approximately 15 degrees to approximately 35 degrees, such as twenty-five degrees, as shown in FIG. 3. The blower 14 may have a cutoff radius P in the range of approximately 0.55 D to approximately 0.625 D where D is the outer diameter of the fan 32. The position of the cutoff 72 may be fixed by way of one or more fasteners 75 or welds, as some examples. In other examples, there are guides (not shown) attached to the inner portions of sidewalls 47, 49 that guide and support the cutoff 72. The guides may be tabs that extend inward from the sidewalls 47, 49 that are proximal to the outer wall 46. The guides may be sufficiently close to the outer wall 46 such that the cutoff 72 can be adjusted in directions 78A, 78B with force but is held in place by the friction placed on the cutoff 72 by the outer wall 46 and the guides. In other examples, the guides direct the cutoff 72 during adjustment, but the position of the cutoff 72 is held in place by a screw extender, ball and detent, or manually sliding the cutoff 72 and pinning or fastening the cutoff 72 in the desired position as examples. The cutoff 72 includes a cutoff lip 76 which may have a curved cross-section as shown in FIG. 3. The cutoff lip 76 has ends 76A, 76B in contact with respective sidewalls 47, 49. The cutoff lip 76 may also have a substantially V-shaped cross section. The cutoff lip 76 directs air out of the blower outlet opening 52 and keeps the air from flowing back around the fan 32. The cutoff lip 76 may be curved such that there is little gap between the cutoff lip 76 and the fan 32 to further prevent air from flowing back around the fan 32. The cutoff lip 76 also aids to prohibit the cutoff 72 from being adjusted in direction 78B too far such that the cutoff 72 is fully within the blower housing 30. If the cutoff 72 is fully within the blower housing 30, it may be difficult and troublesome to readjust the cutoff 72 in direction 78, especially if the cutoff 72 has fallen inside the blower housing 30.

Further, the adjustable cutoff 70 includes lateral supports 77 for resisting deflection of the cutoff 72 in direction 79 as shown in FIG. 3. In one embodiment, the lateral support 77 includes a pair of machine screws that extend through openings in the side walls 47, 49 of the blower housing 30. Nuts, such as square nuts, may be connected to the shanks of the machine screws to keep the machine screws in position. Alternatively, the lateral supports 77 include pin(s) carried on the cutoff 72 and extending toward the sidewalls 47, 49 configured to fit into a hole or slot formed in the sidewalls 47, 49. In another example, the lateral supports 77 may be attached to the sidewalls 47, 49 by a weld. The lateral supports 77 may also be held in place by any type of fastener, for example, a rivet.

The fan 32 may be a fan as disclosed in U.S. Pat. No. 8,881,396, which is incorporated herein by reference. In one embodiment, the fan 32 includes end rings 80 and a solid central hub 82 as shown in FIG. 3. The hub 82 is mounted to an output shaft 84 of the motor 34. The fan 32 includes a plurality of blades 85 that are forward inclined. The blades 85 each have an airfoil shaped cross-section. The blades 85 also each have a compound radius, meaning the blade has a cross-section with a plurality of radii. The compound radius configuration of the blades 85 permits the angle of attack, the inlet angle, and outlet angle of the blades 85 to be optimized for a particular application. Further, the number of the blades 85 may be selected to optimize performance for a particular application.

With reference to FIG. 3, the outer wall 46 may be an assembly including a primary wall 46A and the cutoff 72. The primary wall 46A extends continuously and without interruption from a first end 90 to a second end 92. The first end 90 includes a flange 93 that extends outward and away from the cutoff 72. The second end 92 includes a flange 94 that extends outward from the second end 92. In some embodiments, the outer wall 46 does not include the flange 94 and instead ends at the second end 92. The primary wall 46A may have a unitary, one-piece construction. The primary wall 46A may also be comprised of separate pieces connected together to form a substantially continuous wall. The separate pieces of the primary wall 46A may be connected together by one or more welds, as one example.

Figure 4:
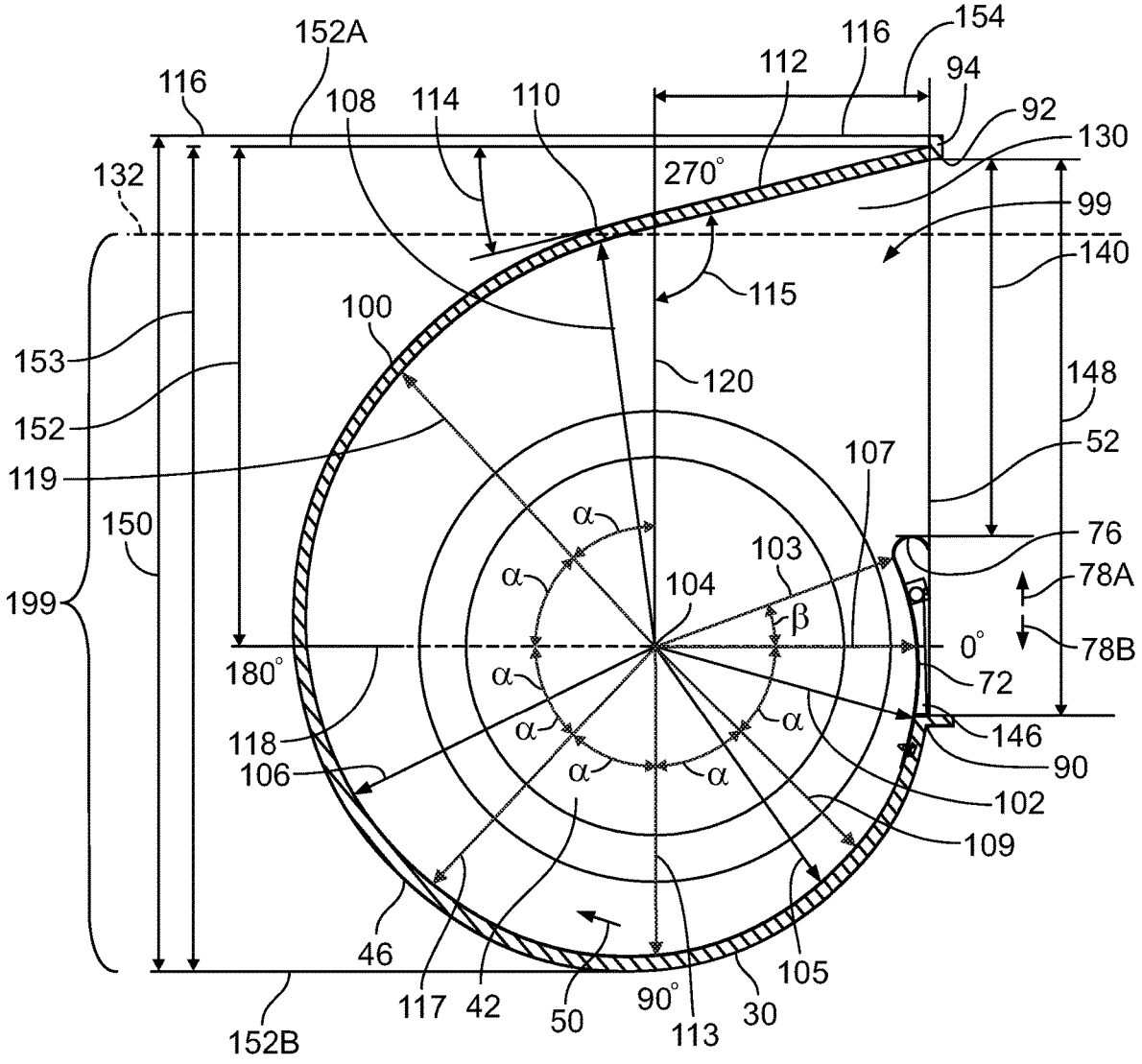
FIG. 4 is a cross-sectional view of the housing of the blower of FIG. 3 showing a flared outlet portion of an outer wall of the housing.

Turning to FIG. 4, the outer wall 46 includes a scroll portion 100 and an end portion 112. The scroll portion has an initial radius 102 extending from the rotational axis 104 of the fan 32 to the first end 90 of the outer wall 46. As the scroll portion 100 extends around the fan 32 in the direction 50 of air flow, the scroll portion 100 has a radius that increases from the radius 102, to a second radius 105, a third radius 106, and a fourth radius 108. In one embodiment, the radius increases continuously. For example, the scroll portion 100 of the outer wall 46 may be a portion of an outward spiral that begins at the first end 90 and continues to increase in distance from the rotational axis 104 along the scroll portion 100 until reaching a scroll portion end 110 where the scroll portion connects with the end portion 112. The end portion 112 extends generally tangentially forward from the curving scroll portion 100 at the scroll portion end 110. In one embodiment, the end portion 112 is planar and the angular position of the scroll end portion 110 in FIG. 4 may be defined according to an angle 114 at which the end portion 112 extends inward and intersects the scroll portion 100. The fourth radius 108 is the radius at the scroll portion end 110.

With reference to FIG. 4, the outer wall 46 is shown with angular position measurements of 0°, 90°, 180°, and 270°. In one embodiment, the scroll portion 100 of the outer wall 46 is an approximation of an Archimedean curve from the first end 90 to scroll portion end 110. The outer wall 46 has a radius that increases, e.g., 103, 107, 102, 109, 105, 113, 117, 106, 119, 108, according to the following Archimedean scroll approximation formula as the outer wall 46 extends in direction 50:

$$RH=RW*(1+K*L)$$

In the equation, RH is the radius of the outer wall 46, including the scroll portion 100, of the blower housing 30, e.g. 103, 107, 102, 109, 105, 113, 117, 106, 119, 108, RW is the radius of the wheel for that housing, and K is the trigonometric sine of the scroll development angle desired (also referred to as the scroll expansion angle or diffuser angle). The scroll development angle may be in the range of approximately 4 degrees to approximately 12 degrees, such as approximately 7.5 degrees to approximately 9.5 degrees, such as approximately 7.5 degrees. L is the angle, in radians, to the point being considered, and L ranges from zero to $2\pi$ radians. With reference to FIG. 4, the angle L begins at zero at axis 120 and increases in direction 50 such that, with angle $\beta$ equal to 25 degrees, the angle L at radius 103 is equal to approximately 1.13 radians. In one embodiment, the radius of the scroll portion 100 may be defined according to the equation for RH above, but the cutoff 72 may have a different radius of curvature or may be straight.

The outer wall 46 further includes an outlet portion 112 that extends from the scroll portion end 110 to the second end 92. The outlet portion 112 has a non-scroll shape. In the embodiment shown in FIG. 4, the outlet portion 112 has a substantially straight cross-section. The outlet portion 112 may have a length of approximately eight inches measured from the scroll portion end 110 to the second end 92. Unlike prior blowers, the outlet portion 112 is not parallel with axis 116, but extends obliquely relative to axis 116, thus forming a wider opening 52. The outlet portion 112 forms an angle 114 with axis 116 which gives the outlet portion 112 a flared or tapered shape. The outlet portion 112 forms an evasé 99 of the housing 30. The angle 114 may be in the range of approximately 0.5 degrees to approximately 15 degrees, such as approximately 3 degrees to 15 degrees. For example, the angle 114 may be in the range of approximately 8 degrees to approximately 13 degrees for most air handler and furnace applications. This results in the outlet portion 112 forming an acute angle with an outer wall opening 146, the outer wall opening 146 being defined as the area between the first end 90 and second end 92 of the outer wall 46. This shape of the blower housing 30 improves the airflow out of the blower housing, which will be described in more detail below.

The dimensions and shape of the blower housing 30 are selected according to the following considerations. For a given air handler, the flange 94 is adapted to fit within the air handler and the scroll portion 100 is configured according to the Archimedean equation approximation provided above based on the wheel fan radius. The outer wall 46 is configured so that the outlet portion 112 extends inward from the flange 94 at the largest angle 114 permitted by the interior of the air handler, such as up to 15 degrees. The larger the angle 114, the fewer eddies are formed in the airflow by converting rotational air velocity to planar velocity as well as converting velocity pressure to static pressure, which reduces turbulence in the airflow and increases efficiency, both static and sound efficiency. This also provides better airflow through the heat exchanger leading to more efficient system. The curvature of the scroll portion 100 provides smooth air flow from the cutoff 72 to the outlet portion 112. In one embodiment, the outlet portion 112 is substantially planar. The term substantially planar is intended to encompass a planar wall section as well as a planar wall section with some deviation from planar, such as vertical deviations having a height of 10% or less of the length of the outlet portion 112 in the direction of airflow. In other embodiments, the outlet portion 112 may have one or more curvatures (e.g. concave and/or convex) and/or one or more upstanding structures such as fins to direct airflow, depending on the shape and orientation of the heat exchanger in the air handler or furnace.

The blower housing 30 also has a vertical axis 120 that extends perpendicular to both the axes 116, 118. The intersection of the axes 118, 120 is located at the rotational axis 104 of the fan 32. In one embodiment, the outlet portion 112 extends away from the scroll portion end 110 to the second end 92 at an angle 115 relative to the axis 120 that is greater than 90 degrees.

The angle 114 creates a transition volume 130 within the blower housing 30 that would not exist if the outer wall 46 extended horizontally (as viewed in FIG. 4) on axis 132 after the scroll portion end 110. This transition volume 130 permits air to flow therethrough without being redirected as sharply as in prior blowers. This smoother transition of the air flow from the circumferential direction around the fan 32 to the outward direction toward the heat exchanger 18 produces less turbulence in the air flow and improves efficiency of the blower 14 by up to 30 percent over conventional blowers of this type. The efficiency improvement was established using test standards ASHRAE 37; ASHRAE 51/AMCA 210 or ISO 5801 for airflow testing. In one embodiment, the transition area 130 has a shape resembling a triangular prism defined between the outlet portion 112, a plane extending on axis 132, and the side walls 47, 49. Additionally, the blower 14 provides a quieter operation than conventional blowers of this type by over 3 dB reduction in sound. The quieter operation was established using the ISO 15744 testing layout as well as in an ISO 9614-2 sound intensity method testing lab.

With reference to FIG. 4, the blower outlet opening 52 has a distance 140 thereacross that may be enlarged by adjusting the cutoff 72 in direction 78B or decreased by adjusting the cutoff 72 in direction 78A. This allows the position of the cutoff 72 and the resulting size of the opening 52 to be selected for a particular application. The distance 140 may be in the range of approximately 7.5 inches to approximately 9.5 inches, such as 8.5 inches. For example, a furnace manufacturer may require a desired air flow velocity at a particular pressure to obtain desired heat transfer from the heat exchanger 18. With a given air flow rate produced by the blower 14, the cutoff 72 can be adjusted to provide an area of the opening 52 that results in the desired air flow velocity and pressure for a particular furnace.

The first and second ends 90, 92 of the outer wall 46 define therebetween the outer wall opening 146 having a distance 148 thereacross that is generally fixed. The distance 148 may be in the range of 12 inches to approximately 15 inches, such as 13.67 inches. The cutoff 72 has an outer wall portion 147 (see FIG. 3) that directs air flow around the fan 32 and operates as part of the outer wall 46. In some embodiments, the cutoff 72 is not adjustable and the cutoff 72 may have a one-piece, unitary construction with the primary wall 46A such that the outer wall portion 147 is integral with the rest of the outer wall 46.

Regarding FIG. 4, the blower housing 30 has an overall height 150. The height 150 may be in the range of approximately 18 to approximately 22 inches, such as 20.25 inches. The blower housing 30 also has a distance 152 from the rotational axis 104 of the fan 32 to an upper plane 152A extending through the second end 92 of the outer wall 46. The distance 152 may be in the range of, for example, approximately 11 inches to approximately 13 inches such as 12.11 inches. Still further, the blower housing 30 has a distance 154 from the rotational axis 104 to the second end 92 of the outer wall 46. The distance 154 may be in the range of approximately 5 inches to approximate 8 inches, such as 6.76 inches. The blower housing 30 also has a height 153 defined between the upper plane 152A extending through the upper end 92 of the outer wall 46 and a lower plane 152B extending parallel to plane 152A and intersecting the bottom of the outer wall 46. The blower housing 30 may also have a housing width C (see FIG. 2) defined using the following equation:

$$C=1.25W+0.1D$$

Where C is the housing width in inches, W is the wheel width in inches, and D is the wheel diameter in inches, for forward curved wheels.

While there have been illustrated and described particular embodiments of the present invention, those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept. For example, the blower 30 may be used in other applications such as a fan coil unit. As another example, the angle 114 may be larger than 15 degrees for some applications.

What is claimed is:

1. A blower assembly comprising:

a housing having a pair of side walls and an outer wall connecting the side walls, the outer wall having a cutoff portion and an outlet portion;

wherein the cutoff portion includes a lip having a unitary, one-piece construction, the lip extending from one side wall to the other side wall of the housing;

an outlet of the housing defined at least in part by an outlet end of the outlet portion and the lip of the cutoff portion;

a scroll portion of the outer wall connecting the cutoff portion and the outlet portion, wherein the scroll portion and the outlet portion of the outer wall have a unitary, one-piece construction;

the outlet portion flaring outwardly away from the cutoff portion as the outlet portion extends from the scroll portion to the outlet end of the outlet portion; and a slide connection that permits the cutoff portion to be shifted toward the outlet portion to decrease the size of the housing outlet and away from the outlet portion to increase the size of the housing outlet.

2. The blower assembly of claim 1, wherein the outlet portion of the housing outer wall is substantially planar.

3. The blower assembly of claim 2, wherein the outer wall includes a scroll portion end between the scroll portion and the outlet portion, the scroll portion end forming a transition from the curvature of the scroll portion to the outlet portion.

4. The blower assembly of claim 1 wherein the scroll portion has an inner radius that increases continuously as the scroll portion extends from the cutoff portion to the outlet portion.

5. The blower assembly of claim 1 wherein the scroll portion has a radius of curvature (RH) defined according to the following equation:

$$RH=RW*(1+K*L)$$

wherein:

K is the sine of a development angle in the range of 0.13 radians to 0.17 radians, L is the angle, in radians, between a portion of the scroll portion having the RH and a position adjacent a connection between the scroll portion and the outlet portion, and RW is an outer radius of a fan for use with the blower assembly.

6. The blower assembly of claim 1 wherein the housing has a height defined between an upper plane extending through the outlet end of the outlet portion and a lower plane extending tangential to a bottom of the outer wall, the upper and lower planes being parallel; and the outlet portion extends transversely to the upper plane.

7. The blower assembly of claim 6 wherein the outlet portion extends at an angle in the range of 8 degrees to 13 degrees relative to the upper plane.

8. The blower assembly of claim 1, wherein the outer wall includes a primary wall having a unitary, one-piece construction, the primary wall including the scroll portion and the outlet portion.

9. The blower assembly of claim 8, wherein the slide connection permits the cutoff portion to be moved relative to the primary wall.

10. The blower assembly of claim 1, further comprising a fan and a motor connected to the fan.

11. A blower assembly comprising:

a fan;

a motor connected to the fan;

a housing having a pair of side walls and an outer wall assembly connecting the side walls;

a primary wall of the outer wall assembly including a scroll portion and an outlet portion;

a cutoff of the outer wall assembly, the cutoff having a unitary, one-piece construction;

a lip of the cutoff extending from one side wall to the other side wall;

an outlet of the housing defined at least in part by the outlet portion of the primary wall, the side walls, and the lip of the cutoff; and a slide connection that permits the cutoff to be shifted toward the outlet portion to decrease the size of the housing outlet and away from the outlet portion to increase the size of the housing outlet.

12. The blower assembly of claim 11, wherein the slide connection permits the cutoff to be slid relative to the primary wall.

13. The blower assembly of claim 11, wherein the slide connection includes a releasable connection between the cutoff and the primary wall.

14. The blower assembly of claim 11, further comprising a lateral support to resist deflection of the cutoff.

15. The blower assembly of claim 11, wherein the outlet portion of the primary wall flares outwardly away from the cutoff as the outlet portion extends away from the scroll portion.

16. The blower assembly of claim 11, wherein the fan is a wheel fan rotatable about an axis and having a width (W) along the axis and an outer diameter (D); and the housing has a width (C) between the side walls of the housing defined by the equation: $C=1.25W+0.1D$.

17. The blower assembly of claim 11 wherein the cutoff has opposite sides contacting the side walls of the housing.

18. The blower assembly of claim 17 wherein the opposite sides of the cutoff each include an edge contacting one of the side walls of the housing.

19. The blower assembly of claim 17 wherein the slide connection includes a pair of guides, each guide supporting one of the sides of the cutoff.

20. The blower assembly of claim 1 wherein the lip has opposite sides contacting the side walls of the housing.

* * * * *